US006430763B2

(12) United States Patent
Kosumsuppamala et al.

(10) Patent No.: US 6,430,763 B2
(45) **Date of Patent: *Aug. 13, 2002**

(54) SIDE BOLSTER SYSTEM FOR A MATTRESS

(75) Inventors: Suppawat Kosumsuppamala, Mt. Pleasant; Timothy G. Clark, Charleston; Ronald B. Jalbert, North Charleston, all of SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/879,678

(22) Filed: Jun. 12, 2001

Related U.S. Application Data

(63) Continuation of application No. 09/458,931, filed on Dec. 10, 1999, now Pat. No. 6,243,894.
(60) Provisional application No. 60/111,939, filed on Dec. 11, 1999.

(51) Int. Cl.[7] ..... A47C 21/00; A47C 21/08
(52) U.S. Cl. ..... 5/425; 5/713
(58) Field of Search ..... 5/424, 425, 678, 5/679, 680, 732, 739, 713, 663

(56) References Cited

U.S. PATENT DOCUMENTS

| | | | | |
|---|---|---|---|---|
| 1,682,394 A | | 8/1928 | Meutsch | |
| 1,885,974 A | | 11/1932 | Winn | |
| 3,735,432 A | * | 5/1973 | Kreten et al. | 5/680 |
| 4,106,138 A | | 8/1978 | Murphy | |
| 4,491,993 A | | 1/1985 | Santo | |
| 4,757,564 A | | 7/1988 | Goodale | |
| 4,799,277 A | * | 1/1989 | Goodale | 5/680 |
| 4,872,228 A | | 10/1989 | Bishop | |
| 4,991,244 A | | 2/1991 | Walker | |
| 4,998,310 A | | 3/1991 | Olson | |
| 5,035,014 A | | 7/1991 | Blanchard | |
| 5,111,542 A | | 5/1992 | Farley | |
| 5,191,663 A | | 3/1993 | Holder et al. | |
| 5,530,974 A | | 7/1996 | Rains et al. | |
| 5,537,699 A | | 7/1996 | Bonaddio et al. | |
| 5,542,135 A | | 8/1996 | Ozrovitz et al. | |
| 5,557,813 A | | 9/1996 | Steed et al. | |
| 5,636,397 A | | 6/1997 | Boyd et al. | |
| 5,642,546 A | | 7/1997 | Shoenhair | |
| 5,699,570 A | | 12/1997 | Wilkinson et al. | |
| 5,701,623 A | | 12/1997 | May | |
| 5,704,085 A | | 1/1998 | Sabalaskey | |
| 5,787,532 A | | 8/1998 | Langer et al. | |
| 5,794,288 A | | 8/1998 | Soltani et al. | |
| 5,802,646 A | | 9/1998 | Stolpmann et al. | |
| 5,910,080 A | | 6/1999 | Selton | |
| 5,956,787 A | | 9/1999 | James et al. | |
| 5,960,497 A | | 10/1999 | Castellino et al. | |
| 5,987,666 A | | 11/1999 | Zigmont | |
| 6,081,950 A | | 7/2000 | Selton | |
| 6,085,372 A | | 7/2000 | James et al. | |
| 6,223,369 B1 | | 5/2001 | Maier et al. | |
| 6,223,370 B1 | | 5/2001 | Kluft | |
| 6,249,924 B1 | | 6/2001 | Kluft | |
| 6,256,822 B1 | | 7/2001 | Weston et al. | |

FOREIGN PATENT DOCUMENTS

| | | | | |
|---|---|---|---|---|
| EP | 81/01792 | | 7/1981 | |
| GB | 2 163 951 A | | 3/1986 | |
| GB | 2229907 A | * | 10/1990 | 5/678 |
| NL | 8300814 | * | 3/1983 | 5/706 |

* cited by examiner

*Primary Examiner*—Alexander Grosz
(74) *Attorney, Agent, or Firm*—Bose McKinney & Evans LLP

(57) ABSTRACT

A side bolster system is provided for use with a mattress having a first side and a second side. The side bolster system of the present invention includes a first side bolster configured to be positioned along the first side of the mattress, and a second side bolster configured to be positioned along the second side of the mattress.

20 Claims, 4 Drawing Sheets

SIDE BOLSTER SYSTEM FOR A MATTRESS

RELATED APPLICATIONS

This application is a continuation application of application Ser. No. 09/458,931, filed Dec. 10, 1999, now U.S. Pat. No. 6,243,894, the disclosure of which is incorporated herein by reference, which claims the benefit of U.S. provisional application, Ser. No. 60/111,939 filed Dec. 11, 1999.

BACKGROUND AND SUMMARY OF THE INVENTION

The present invention relates to a mattress for a bed, and particularly to a side bolster system for a mattress. More particularly, the present invention relates to a side bolster system having a pair of opposing longitudinally-extending side bolsters that provide lateral support to the mattress.

Conventional mattresses provide a soft surface on which a person may lie. Some mattresses do not have sufficient lateral support along the sides of the mattress to adequately keep the person in a desired position on the bed.

A side bolster system of the present invention includes a pair of side bolsters positioned on opposite sides of a mattress. The side bolsters provide lateral support to the mattress. The bolsters are positioned along opposite sides of the mattress to minimize the effort needed in getting on or off the mattress while maintaining adequate support of the mattress. In other words, the bolsters improve a person's stability while positioned on the mattress without hindering the person's ability to egress from the mattress. The side bolster system of the present invention includes a first side bolster configured to be positioned along a first side of the mattress, a second side bolster configured to be positioned along a second side of the mattress, and a transverse tether having a first end coupled to the first side bolster and a second end coupled to the second side bolster.

In an illustrated embodiment of the present invention, the side bolster system includes a shoulder bolster section located adjacent a head end of the mattress, and a seat bolster section located toward the foot end of the mattress from the shoulder bolster section. The shoulder bolster section includes an elongated first shoulder bolster positioned along the first side of the mattress and an elongated second shoulder bolster positioned along the second side of the mattress. The seat bolster section includes an elongated first seat bolster positioned along the first side of the mattress and an elongated second seat bolster positioned along the second side of the mattress. The side bolster system also includes a plurality of tether links connecting the first shoulder bolster to the first seat bolster, the second shoulder bolster to the second seat bolster, the first shoulder bolster to the second shoulder bolster, and the first seat bolster to the second seat bolster.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the accompanying drawings in which.

DETAILED DESCRIPTION OF THE DRAWINGS

Figure 1:
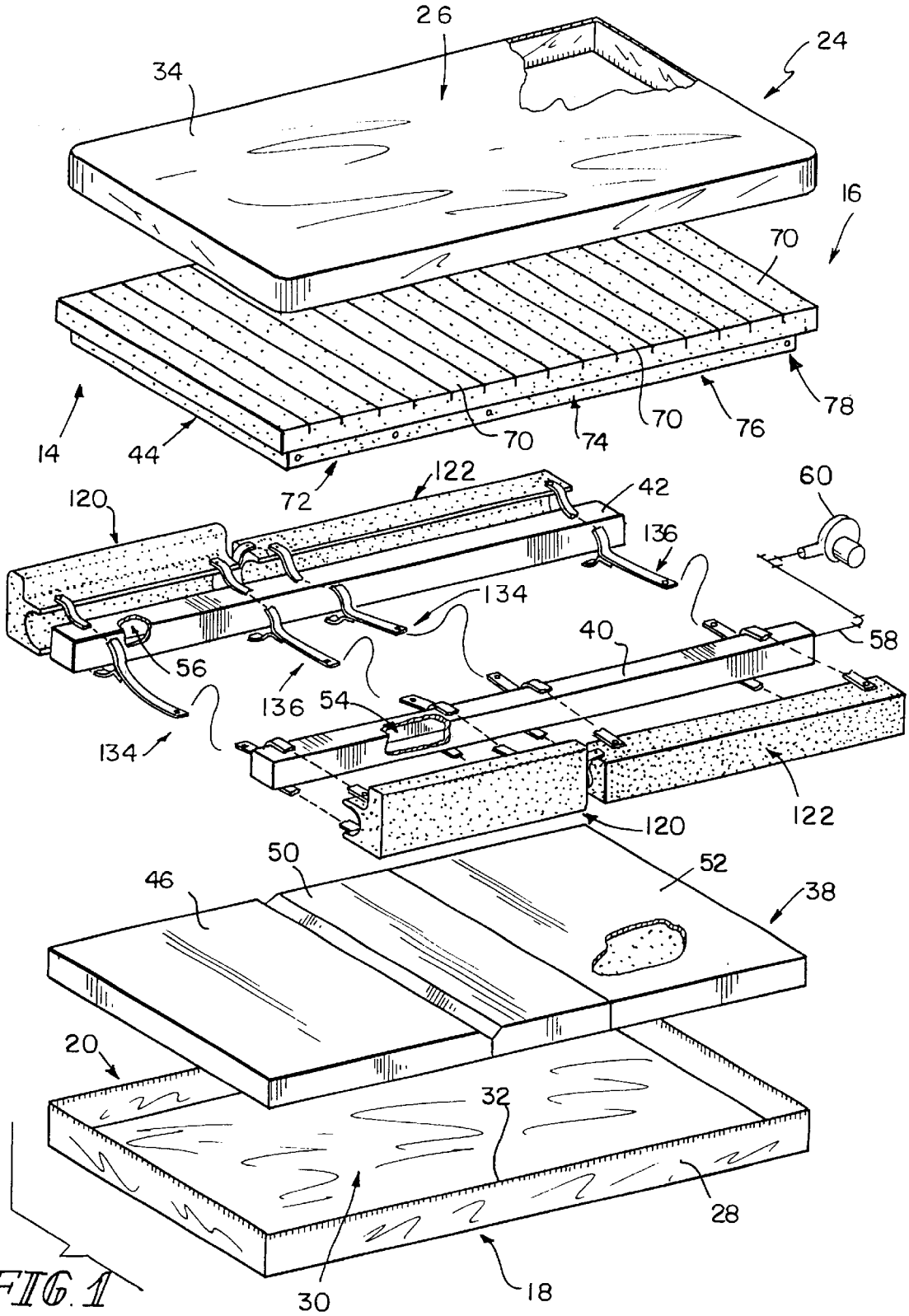
FIG. 1 is an exploded perspective view of a mattress assembly including a mattress cover having an interior region configured to receive a mattress core, the mattress core including a foam base, longitudinally-extending side members positioned to lie above the foam base, one of the side members defining a manifold in fluid communication with a source of pressurized fluid through a hose connected to the side member, and an air mattress including a plurality of transversely-extending air sacks positioned to lie above the foam base and above the side members, and a side bolster system of the present invention to help maintain a person in a desired position on the mattress.

Referring now to the drawings, FIG. 1 illustrates a mattress assembly 12 includes a head end 14, a foot end 16 longitudinally spaced-apart from head end 14, a longitudinally-extending first side 18, and a longitudinally-extending second side 20 spaced apart from first side 18. Mattress assembly 12 is equally appropriate for use both in an institutional facility, such as a hospital or a group care home, and for "in-home" use by consumers.

As used in this description, the phrase "head end 14" will be used to denote the end of any referred-to object that is positioned to lie nearest head end 14 of bed 10 and the phrase "foot end 16" will be used to denote the end of any referred-to object that is positioned to lie nearest to foot end 16. Likewise, the phrase "first side 18" will be used to denote the side of any referred-to object that is positioned to lie nearest the first side 18 of mattress assembly 12 and the phrase "second side 20" will be used to denote the side of any referred-to object that is positioned to lie nearest the second side 20 of mattress assembly 12.

Figure 3:
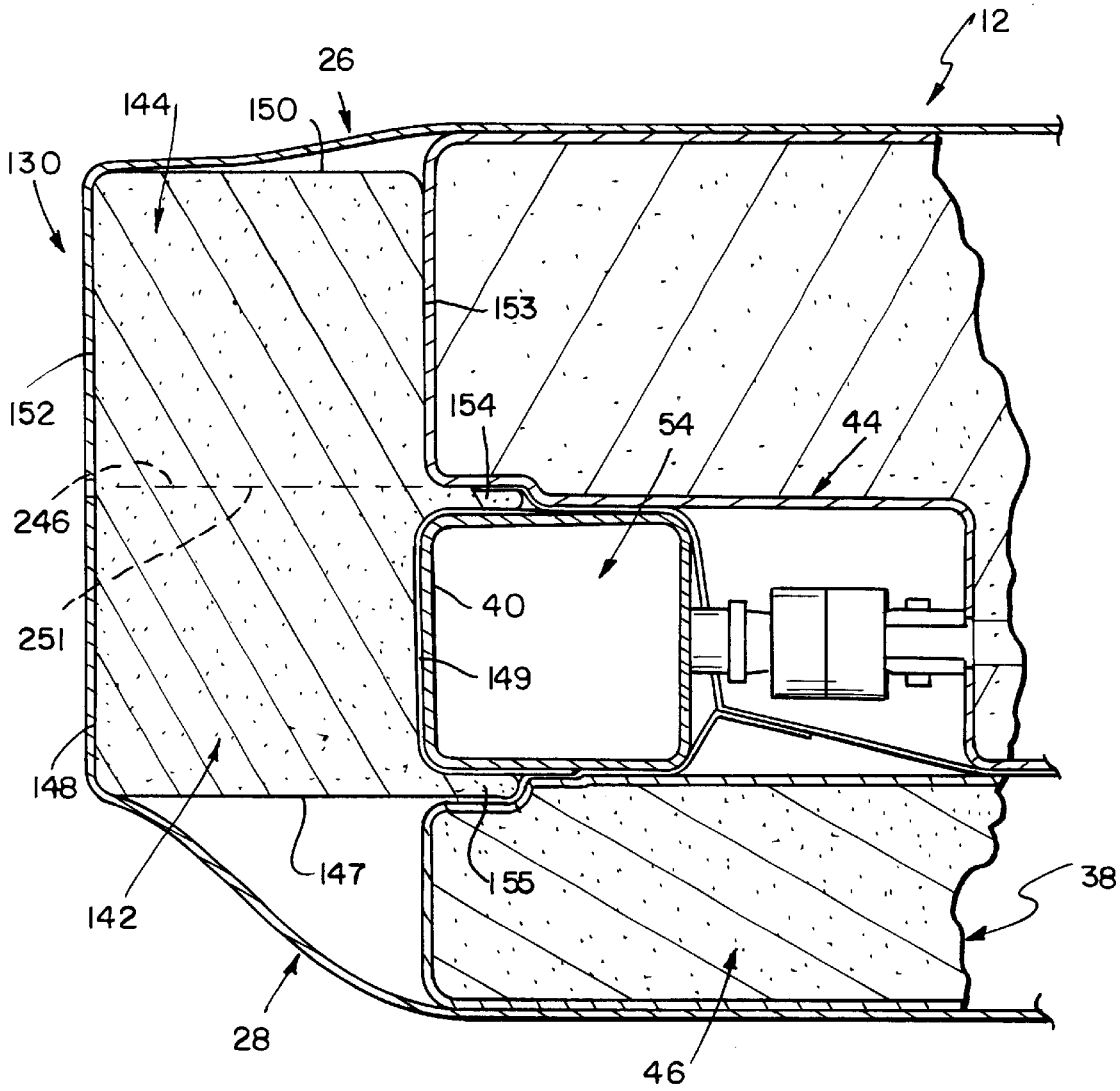
FIG. 3 is a sectional view taken through the mattress assembly of FIG. 1 illustrating one of the shoulder bolsters having a primary support section extending partially around one of the side members of the mattress core and a secondary support portion extending upwardly from the primary support portion to engage a side wall of the air mattress, and showing the foam base positioned to lie beneath one of the side members and the air mattress positioned to lie on top of the foam base and on top of the side member, the side member being formed to include a manifold in fluid communication with an air sack of the air bladder through a flow control assembly.
Figure 4:
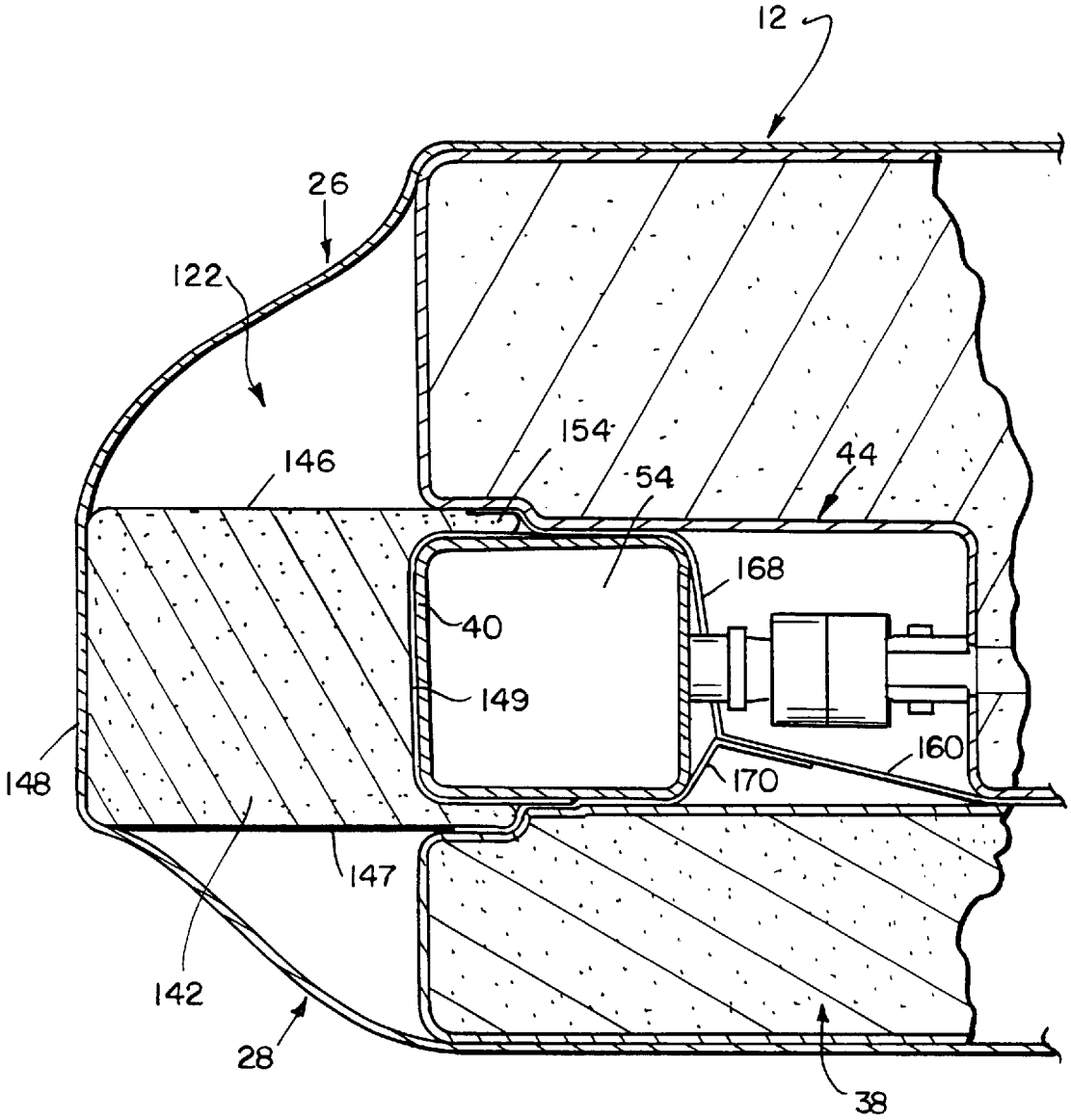
FIG. 4 is a sectional view similar to FIG. 3 illustrating one of the seat bolsters installed in a seat section of the mattress assembly.

Mattress assembly 12, as shown in FIGS. 1, 3 and 4 is described in detail in U.S. Pat. No. 5,794,288 to Soltani et al., the disclosure of which is incorporated herein by reference. Mattress assembly 12 includes a cover 24 having a top cover 26 and a bottom cover 28 connected to top cover 26 by a zipper 32 as shown in FIG. 1. Top cover 26 includes a generally upwardly-facing sleeping surface 34 above which a user will rest. Top and bottom covers 26, 28 of mattress cover 24 cooperate to define an interior region 30 of mattress cover 24. Illustrative and preferred cover 24 is made from material such as P061 material made by Penn Nyla located in Europe. The material of cover 24 is illustratively semi-permeable allowing air to pass therethrough but sealing mattress system 12 against the ingress of moisture. Such ticking material is well-known for use with "low air loss" mattresses of the type described below and disclosed in U.S. Pat. No. 4,919,414 to Thomas et al., the specification of which is hereby incorporated by reference.

Interior region 30 of mattress cover 24 receives a mattress core which includes a foam base 38, a longitudinally-extending first side member 40 positioned to lie above foam base 38 and adjacent to first side 18 of foam base 38, a longitudinally-extending second side member 42 positioned to lie above foam base 38 adjacent to second side 20 of foam base 38, and an air mattress 44 positioned to lie above foam base 38 and above first and second side members 40, 42 as shown in FIGS. 3 and 4. Mattress cover 24 holds the elements of mattress core together and provides an interface between mattress assembly 12 and the person supported by mattress assembly 12.

Foam base 38 is illustratively made from a plurality of longitudinally spaced base sections including a head section 46 adjacent to head end 14 of mattress assembly 12, a seat section 50 adjacent to head section 46, and a leg section 52 adjacent to seat section 50 and adjacent to foot end 16 of mattress assembly 12 as shown in FIG. 1. Foam base 38 is preferably made from foam rubber such as polyurethane foam which is well known and commonly used for producing foam mattresses. Each illustrated base section is covered by medical grade staff-check ticking such as the ticking material from which mattress cover 24 is made. Preferably, the ticking material covering base sections is Staff Check XL material made by Herculite.

The illustrated first and second side members 40, 42 are elongated air bladders defining interior regions 54, 56, respectively. First and second side members 40, 42 are preferably made from urethane having polyester knit reinforcement. Side members 40, 42 are inelastic so that when side members 40, 42 are inflated they provide rigid supports along first and second sides 18, 20 of mattress assembly 12.

In the illustrated embodiment, a conduit 58 connects first side member 40 to a source of pressurized fluid 60 as shown diagrammatically in FIG. 1 so that interior region 54 of first side member 40 is in fluid communication with a source of pressurized fluid 60. Also in preferred embodiments, a second conduit (not shown) connects second side member 42 to first side member 40 so that interior region 56 of second side member 42 is in fluid communication with interior region 54 of first side member 40. Thus, the interior region 54 of first side member 40 and interior region 56 of second side member 42 are each in fluid communication with source of pressurized fluid 60 and each contains pressurized fluid that is pressurized to substantially the same pressure in each interior region 54, 56.

The mattress core of mattress assembly 12 additionally includes air mattress 44 which has a plurality of longitudinally-spaced apart and transversely extending air sacks 70. Air mattress 44 provides mattress assembly 12 with firmness and support characteristics that can be varied by varying the pressure of the pressurized fluid in the interior regions of each air sack 70. Illustratively, air mattress 44 includes four air sacks 70, although there is no limit to the number of air sacks 70 that can be included with air mattress 44 of mattress assembly 12 and controlled by a control assembly in accordance with the present invention. In addition, although air sacks 70 of air mattress 44 are longitudinally spaced apart and extend transversely, the shapes and relative positioning of air sacks 70 can be varied without exceeding the scope of the invention as presently perceived.

The illustrated air mattress 44 includes a head section air zone 72 adjacent to head end 14 of bed 10 and positioned to lie above head section 46 of foam base 38, a back section air zone 74 adjacent to head section air zone 72 and positioned to lie above head section 46 of foam base 38, a seat section air zone 76 adjacent to back section air zone 74 and positioned to lie above seat section 50 and leg section 52 of foam base 38, and a leg section air zone 78 positioned to lie adjacent to seat section air zone 76 and positioned to lie above leg section 52 of foam base 38 and adjacent to foot end 16 of mattress assembly 12. The flow of pressurized fluid from side members 40, 42 to air mattress 44 is described in detail in the '288 patent.

Figure 2:
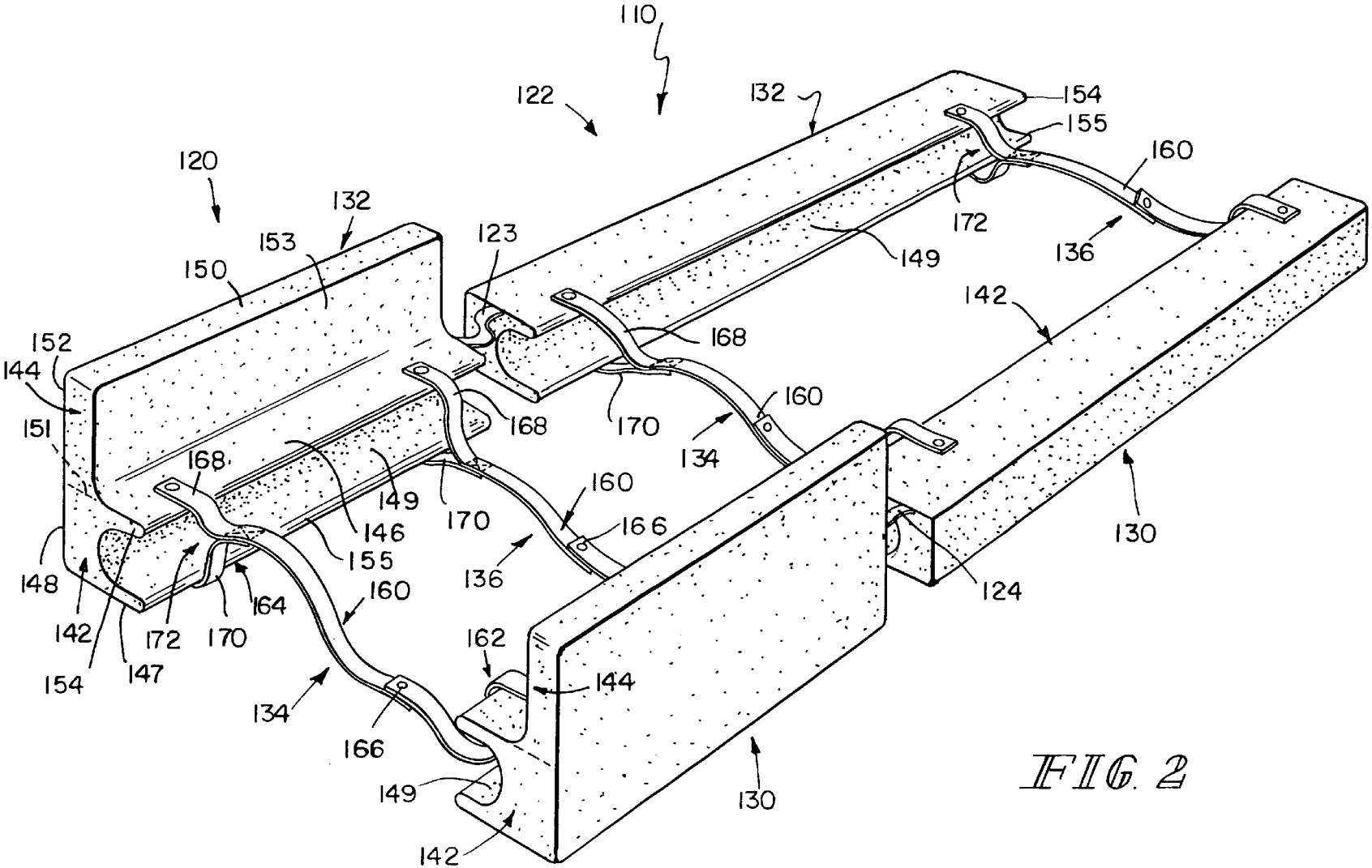
FIG. 2 is a perspective view of the side bolster system of the present invention including first and second shoulder bolsters, first and second seat bolsters, and a plurality of tethers interconnecting the bolsters.

FIG. 2 illustrates a side bolster system 110 in accordance with the present invention. Side bolster system 110 is adapted for use with the mattress assembly 12. Side bolster system 110 is configured to extend longitudinally along the opposite sides 18 and 20 of mattress assembly 12 to provide lateral support to mattress assembly 12, without impeding entry or exit from mattress assembly 12.

The mattress assembly 12 can be used on any type of bed such as a bed for use in a hospital or other care facility, a bed for use in a home, or any other type of bed having an upwardly-facing surface above which a user will rest. Such beds often include an articulating deck having longitudinally-spaced sections that are movable relative to one another. Mattress assembly 12 is compatible with such articulating decks.

Side bolster system 110 is configured to provide support to mattress assembly 12 along first and second sides 18, 20 of mattress assembly 12. The support provided by side bolster system 110 helps to maintain the positioning of a person on the mattress when the person moves toward the sides 18, 20 of mattress assembly 12. Side bolster system 110 includes a shoulder section 120, a seat section 122, and a pair of tether links 123, 124 interconnecting the shoulder section 120 to the seat section 122, as shown in FIGS. 1 and 2.

Shoulder bolsters 120 and seat bolsters 122 illustratively include a foam core surrounded by a cover. The cover is illustratively made from a Penn-Nyla material. Tether links 123, 124 are illustratively sewn to covers on shoulder and seat sections 120, 122, although a wide variety of fastening means (such as snaps, zippers, buttons, Velcro, etc.) could be used to couple the tethers 123, 124 to the shoulder section 120 and seat section 122.

Shoulder section 120 of side bolster system 110 provides support to the head section 46 of mattress assembly 12 along first and second sides 18, 20 of mattress assembly 12 to help maintain the positioning of a person on the mattress assembly 12. Shoulder section 120 strengthens first and second sides 18, 20 of mattress 44 near the head section 46 of mattress assembly 12. Shoulder section 120 of side bolster system 110 includes a first side bolster 130 and a second side bolster 132, as shown in FIGS. 1 and 2. First and second side bolsters 130, 132 are positioned to extend longitudinally along first and second sides 18, 20, respectively, of mattress assembly 12 and are generally aligned with head section 46 of foam base 38. First and second side bolsters 130, 132 are substantially identical to one another, and therefore, the description of one applies equally to the other.

First and second side bolsters 130, 132 each include a primary-support section 142 and a secondary-support section 144 extending vertically upwardly from the primary-support section 142. The primary-support section 142 and secondary support section 144 may be formed as one piece as shown in FIGS. 1 and 2 or as separate pieces (not shown). Each primary-support section 142 includes a top surface 146, a bottom surface 147, an exterior side surface 148, and a concave interior side surface 149. Each secondary-support portion 144 includes a rounded (convex) top surface 150, a bottom surface 151, an exterior surface 152, and an interior surface 153. The bottom surface 151 of the secondary-support portion 144 is positioned to lie on the top surface 146 of primary-support portion 142 when primary and secondary-support portions 142, 144 are separate pieces. When primary and secondary-support portions 142, 144 are formed as one piece, these surfaces 151, 146 are coextensive.

Each side bolster 130, 132 of shoulder section 120 mates with a head end of mattress assembly 12 as shown in FIG. 3. As shown in FIG. 3, the concave interior side surface 149 of primary-support section 142 is sized and shaped to receive first side member 40 of mattress core 36. In addition, the interior side surface 153 of secondary-support portion 144 is configured to engage a side wall of air mattress 44 near the head end 14 of bed 10. Shoulder section 120 of side bolster system 110 is illustratively positioned to lie within cover 24.

It is understood that in another embodiment of the present invention the bolsters 120 and 122 may be located outside the interior region 30 of the cover 24 and attached to the mattress assembly 12 or to a bed on which the mattress assembly 12 is positioned.

A pair of tether links 134, 136 are used to interconnect first side bolster 130 to second side bolster 132, as shown best in FIG. 2. Tether links 134, 136 are longitudinally spaced apart from one another to adequately interconnect first and second side bolsters 130, 132. Each tether link 134, 136 includes a central portion 160 and two opposite end portions 162, 164. The central portion 160 preferably includes an extension mechanism 166 to allow the central portion 160 to be adjusted to various lengths to accommodate varying sizes of mattresses. Each end portion 162, 164 of each tether link 134, 136 includes a first portion 168 and a second portion 170. The first portion 168 is illustratively snapped to the top surface 146 of primary support section 142 and the second portion is illustratively snapped to the bottom surface 147 of primary-support section 142, although a variety of fastening means (such as those discussed above) may be used instead of a snap. The first and second portions 168, 170 of each end portion 162, 164 are preferably sewn to central portion 160, although a wide variety of fastening means (such as those discussed above) could also be used.

First and second portions 168, 170 are fastened to central portion 160 to define an opening 172 between interior side surface 149 of primary support section 142 and first and second portions 168, 170. Opening 172 is sized to receive a respective side member 40, 42 therein, as shown in FIG. 4. Thus, side bolsters 130, 132 are held in place relative to side members 40, 42 by having first and second portions 168, 170 of tether links 134, 136 extend about side members 40, 42.

As shown in FIG. 3, top surface 146, bottom surface 147, and interior side surface 149 of primary support section 142 cooperate to define a first projection 154 and a second projection 155. First projection 154 extends between air mattress 44 and side member 40. Second projection 155 extends between side member 40 and foam base 38. As shown in FIG. 3, both mattress 44 and foam base 38 are flexible and conform to the shape of each projection 154, 155.

As shown diagrammatically in FIG. 3, secondary support section 144 provides lateral support to a head end of mattress 44. This support inhibits the movement of mattress 44 axially outwardly when a person is positioned near a side 18, 20 of mattress 44. Thus, air mattress 44 will substantially maintain its shape along the longitudinal sides of mattress 44 as the person moves closer to the side of the mattress 44.

Seat section 122 of side bolster system 110 is substantially similar to shoulder section 120 and includes a first side bolster 130 and a second side bolster 132. The only difference between seat section 122 and shoulder section 120 is that each side bolster 130, 132 of seat section 122 only includes primary support section 142 and does not include secondary support section 144. Seat section 122 of side bolster system 110 provides some support to mattress assembly 12, but it provides less support than shoulder section 120. Secondary support section 144 is eliminated from seat section 222 so that the person is less inhibited from exiting mattress assembly 12 when the person is in a seated position and trying to exit from an area adjacent to seat section 50 of foam base 38, than if the secondary support section 144 were present. As shown in FIG. 4, seat section 122 includes first and second projections 154, 155 which extend between air mattress 44, side member 40, and foam base 38, in exactly the same manner as did shoulder section 120 which was previously described. In addition, tether links 134, 136 are used to interconnect first and second side bolsters 130, 132 of seat section 122 in exactly the same manner as previously described.

Each side bolster 130, 132 of shoulder section 120 and seat section 122 includes a foam core material defining the primary and secondary support sections 142, 144 and a cover extending around the foam material. The foam material is illustratively of the type known as K155X which is available from Carpenter Company located in Russelville, Ky. In addition the foam material preferably has a density of 2.4 to 2.5 and an ILD of 140 to 160. In addition, the fiber content of the cover is preferably 100% nylon and is available from Unitex-South, located in Fort Lauderdale, Fla.

To install side bolster system 110 onto mattress assembly 12, a user first unzips cover 22 and pull back top cover 26 to obtain access to air mattress 44, side members 40, 42, and foam base 38. The user then positions shoulder section 120 of side bolster system 110 near the head end 14 of mattress assembly 12. First projection 154 is positioned between air mattress 44 and side members 40, 42 and second projection 155 is positioned between side members 40, 42 and foam base 38, respectively. Of course, seat section 122 of side bolster system 110 is positioned in the same manner as shoulder section 120 of side bolster system 110 except that seat section 122 is positioned near the seat section 50 of foam base 38. The user then rolls an air cushion of air mattress 44 back and snaps first and second portions 168, 170 of tether links 134, 136 to the appropriate side bolster 130, 132. The cover 24 can then be positioned around the side bolster system 210 and rezipped.

Shoulder section 120 and seat section 122 each include two pairs of tether links 134, 136. The tether links 134, 136 are spaced longitudinally apart from one another, as shown in FIG. 2, to adequately anchor each side bolster 130, 132 to the first and second sides 18, 20 of mattress assembly 12. Illustratively, as shown in FIG. 2, tether links 134, 136 include a single central portion 260 that extends between air mattress 44 and foam base 38. However, side bolster system 110 could also be configured to include a pair of tether links 134, 136 so that one tether link could extend over mattress 44 and the other tether link could extend under foam base 38. This would allow side bolster system 110 to be installed either inside cover 24 or outside cover 24. Of course, bolster system 110 shown in FIG. 1 could also be installed either inside cover 24 or outside cover 24 by having at least one tether link 134, 136 that extends under bottom cover 28 of mattress assembly 12.

Although the invention has been described in detail with reference to a certain illustrated embodiment, variations and modifications exist within the scope and spirit of the invention as described and as defined in the following claims.

What is claimed is:

1. A side bolster system for a mattress, the mattress including a first side member and a second side member, the side bolster system comprising:

a first bolster, a second bolster, and means for coupling the first bolster to the first side member, the second bolster to the second side member, and the second bolster to the first bolster.

2. The side bolster system of claim 1, wherein the mattress has a top side and a bottom side and the means for coupling the second bolster to the first bolster is adjacent to the bottom side of the mattress.

3. The side bolster system of claim 1, wherein the first bolster has a first length, the second bolster has a second length, the mattress has a perimeter length, and the sum of the first length and the second length is less than the perimeter length.

4. The side bolster system of claim 1, wherein the first and second bolsters are configured to engage the first and second side members, respectively.

5. The side bolster system of claim 1, further comprising a cover having an interior region, wherein the first and second bolsters and the mattress are positioned in the interior region of the cover.

6. The side bolster system of claim 1, wherein the first and second bolsters each include a foam core.

7. A side bolster system for a mattress, the mattress including a first side member and a second side member, the side bolster system comprising:

a first bolster, a second bolster, and means for coupling the first bolster to the first side member, the second bolster to the second side member, and the second bolster to the first bolster, wherein the first side member and the second side member each include a manifold.

8. A side bolster system for a mattress, the mattress including a first side member and a second side member, the side bolster system comprising:

a first bolster positioned along the first side member of the mattress, a second bolster positioned along the second side member of the mattress, and a coupler having a first coupler portion and a second coupler portion, the first coupler portion coupled to the first bolster and the first side member and the second coupler portion coupled to the first coupler portion and the second bolster.

9. The side bolster system of claim 8, wherein the coupler is positioned under a patient support surface of the mattress.

10. The side bolster system of claim 8, wherein the first side member includes an air bladder.

11. The side bolster system of claim 8, wherein the first bolster, the second bolster, the mattress, and the coupler are enclosed in a cover.

12. The side bolster system of claim 8, wherein the first coupler portion is adjustably coupled to the second coupler portion.

13. The side bolster system of claim 8, wherein the first coupler portion extends around the first side member.

14. A side bolster system for a mattress structure, the mattress structure including a base, a mattress positioned above the base, and first and second side members positioned between the mattress and the base, the mattress having first and second sides, the side bolster system comprising:

a first bolster having a concavity configured to mate with the first side of the mattress, a first projection configured to extend between the mattress and the first side member, and a second projection configured to extend between the first side member and the base, and a second bolster having a concavity configured to mate with the second side of the mattress.

15. The mattress assembly of claim 14, further comprising a cover defining an interior region, wherein the mattress and first and second bolsters are positioned inside the interior region.

16. The side bolster system of claim 14, wherein the first bolster includes a first shoulder bolster and a first seat bolster and the second bolster includes a second shoulder bolster and a second seat bolster.

17. The side bolster system of claim 16, wherein the mattress has a head end and a foot end spaced apart from the head end, the first and second shoulder bolsters are located adjacent the head end of the mattress and the first and second seat bolsters are located adjacent the foot end of the mattress.

18. The side bolster system of claim 14, further comprising a coupler coupled to the first and second bolsters.

19. The side bolster system of claim 14, wherein the mattress includes first and second members positioned along the first and second sides of the mattress, respectively, and the first and second bolsters are configured to receive the first and second members, respectively.

20. A side bolster system for a mattress, the mattress including a first side member and a second side member, the side bolster system comprising:

a first bolster, a second bolster, and means for coupling the first bolster to the first side member, the second bolster to the second side member, and the second bolster to the first bolster, wherein the first and second members each include a manifold.

* * * * *